US005635799A

United States Patent [19]

Hesterman

[11] Patent Number: 5,635,799

[45] Date of Patent: Jun. 3, 1997

[54] LAMP PROTECTION CIRCUIT FOR ELECTRONIC BALLASTS

[75] Inventor: Bryce L. Hesterman, Fort Wayne, Ind.

[73] Assignee: Magnetek, Nashville, Tenn.

[21] Appl. No.: 644,209

[22] Filed: May 10, 1996

[51] Int. Cl.[6] ..... H05B 37/02

[52] U.S. Cl. ..... 315/127; 315/225

[58] Field of Search ..... 315/225, 127, 315/DIG. 7, 307

[56] References Cited

U.S. PATENT DOCUMENTS

| | | | |
|---|---|---|---|
| Re. 32,901 | 4/1989 | Nilssen | 315/244 |
| Re. 32,953 | 6/1989 | Nilssen | 315/224 |
| 4,398,126 | 8/1983 | Zuchtriegel | 315/127 |
| 4,503,363 | 3/1985 | Nilssen | 315/225 |
| 4,562,383 | 12/1985 | Kerscher | 315/225 |
| 4,667,131 | 5/1987 | Nilssen | 315/275 |
| 5,004,955 | 4/1991 | Nilssen | 315/119 |
| 5,436,529 | 7/1995 | Bobel | 315/127 |
| 5,475,284 | 12/1995 | Lester et al. | 315/225 |
| 5,493,180 | 2/1996 | Bezdon | 315/91 |

*Primary Examiner*—Robert Pascal
*Assistant Examiner*—Michael Shingleton
*Attorney, Agent, or Firm*—Mark P. Bourgeois

[57] ABSTRACT

An electronic ballast has a protection circuit particularly useful for smaller diameter gas discharge lamps including compact fluorescent lamps. The protection circuit prevents lamps from overheating by preventing the ballast from providing sustained output power when the magnitude of the ballast output voltage indicates abnormal lamp operation. The protection circuit has a voltage sensor which develops a voltage that is more negative than the negative DC supply terminal of the inverter so that an inexpensive low-voltage SCR can be used to turn off the inverter. The circuit provides automatic restarting of the ballast after a new lamp has been installed to eliminate the need for toggling the input power to the ballast.

20 Claims, 4 Drawing Sheets

LAMP PROTECTION CIRCUIT FOR ELECTRONIC BALLASTS

APPLICATION FOR UNITED STATES LETTERS PATENT

Be it known that I, Bryce L. Hesterman, a citizen of the United States, residing at 9028 Timbermill Run, Fort Wayne, Ind. 46804 have invented a new and useful, "Lamp Protection Circuit for Electronic Ballasts."

BACKGROUND OF THE INVENTION

This invention relates to an electronic ballast with a protection circuit for small-diameter gas discharge lamps and for compact fluorescent lamps in particular. The protection circuit acts to shut down an electronic ballast when a fault condition is sensed.

Fluorescent lamps contain a tungsten filament in each end of the lamp which is coated with an emissive material that has a lower work function than tungsten. As fluorescent lamps age, the emissive coating material on the filaments is worn away so that the arc must flow from the bare tungsten filament. The work function of the tungsten filament is high, so several watts of power are dissipated in the cathode fall region near the filament. This extra power dissipation can lead to overheating of the lamp. In some cases, the glass tube may melt or crack. Occasionally, the plastic base of compact fluorescent lamps may become deformed.

When a lamp with a worn-out filament is operating with a high cathode fall voltage, the arc voltage increases. The arc voltage may become asymmetrical if one filament is more worn than the other. The increased voltage due to one or more worn-out filaments can be sensed and used to actuate a shutdown circuit.

Prior attempts at gas discharge lamp ballasts with shutdown circuits have resulted in implementations with various drawbacks. U.S. patents RE 32,901, RE 32,953, and 5,004,955. show ballast shutdown circuits that sense an overvoltage condition in the resonant output circuit. They require a voltage clamp (varistor) to conduct before the shutdown circuit can be activated. The purpose of these circuits is to prevent a shock hazard at the output terminals and not to protect the lamp. They are designed to sense large output voltage levels that occur when a lamp does not strike. Consequently, they may not be able to sense the arc voltage levels associated with overheating, which are not nearly as large.

Other prior art shutdown circuits that were designed to sense large overvoltage conditions could be adjusted to trigger at lower voltage levels because their sensing circuits do not clamp the open-circuit voltage. These circuits, however, typically use a diac as the threshold sensing device. Typical diacs have a loose tolerance on the trigger voltage level, and therefore may not have the accuracy required for sensing overvoltage levels associated with lamp overheating. Examples of non-clamping, diac triggered circuits are found in U.S. Pat. Nos. 4,398,126, 4,503,363, 4,667,131, and 5,436,529. These circuits may also have other disadvantages. U.S. Pat. No. 4,398,126 uses a costly high-voltage silicon controlled rectifier (SCR), and requires turning the power off and on after a new lamp is installed before the lamps will strike. The need to toggle the input power is not a desirable feature when many ballasts are operated on one AC circuit. U.S. Pat. Nos. 4,667,131, and 4,503,363 show protection circuits that have complicated shutdown circuits. A sense voltage related to the arc voltage triggers a diac which triggers an SCR. The SCR turns on a transistor which shuts down the inverter. The shutdown transistor is required in this circuit because the conduction voltage of an SCR is greater than the turn-on voltage of a bipolar transistor. U.S. Pat. No. 5,493,180 shows circuits that are capable of sensing lamp voltages associated with overheating, but they are fairly complicated.

U.S. Pat. Nos. 4,562,383 and 5,436,529 show shutdown circuits that have the desirable property of causing the ballast to remain off until the bad lamp is replaced. These circuits, however, suffer from other problems described above.

SUMMARY

An object of the invention is to provide a simple low-cost protection circuit for smaller diameter gas discharge lamps including compact fluorescent lamps. An electronic ballast includes a lamp protection circuit for protecting at least one gas discharge lamp from overheating by preventing the ballast from providing sustained output power when the magnitude of the ballast output voltage indicates abnormal lamp operation.

When power is first applied to the ballast, a starting circuit provides a pulse to the base of a transistor that has an emitter coupled to a negative DC supply rail to initiate oscillations in an inverter. After the inverter is operating, a voltage sensor provides at a voltage-sensor output terminal a DC sense voltage having a magnitude that is directly related to the magnitude of inverter output voltage and negative in polarity with respect to the negative DC supply terminal. The voltage sensor includes a delay capacitor connected between the negative DC supply terminal and the voltage-sensor output terminal for delaying the response of the DC sense voltage to changes in the inverter output voltage. The delay allows the ballast to have a high output voltage for a period long enough to start good lamps.

If the magnitude of the DC sense voltage exceeds a threshold level that indicates abnormal lamp operation, then a trigger circuit fires an SCR, thereby providing a negative pulse to shut off the inverter by discharging the delay capacitor into the control terminal of the switching transistor. Using a negatively charged capacitor allows an inexpensive low-voltage SCR to shut down the inverter without requiring a shutdown transistor as in prior art circuits.

An inhibit circuit prevents the starting circuit from restarting of the gas discharge lamp after it has been extinguished. The inhibit circuit has an inhibit control terminal that is connected to a continuity sensor. The output signal of the continuity sensor is interrupted if a lamp is removed from the circuit. The inhibit circuit has a delay between the time that the continuity sensor output signal is received and the time at which the starting circuit is inhibited. Thus, when the ballast is first turned on, the starting circuit is not disabled. When the ballast is shut off by the SCR, however, the starting circuit is disabled by the inhibit circuit. Removing a lamp from the circuit, such as when a bad lamp is being replaced, allows the starting circuit to function since the continuity sensor output signal is interrupted. The inverter has a resonant capacitor connected to at least two of the inverter output terminals so that a resonant current flowing through the resonant capacitor also flows though at least one lamp filament. This prevents the inverter from starting when lamp removal or filament breakage prevents the resonant current from flowing. Thus, the inverter will not start when a lamp is missing, but will start when the lamp is replaced. This feature avoids the situation of having to toggle the input power to the ballast to get the ballast to restart after a bad lamp has been replaced.

BRIEF DESCRIPTION OF THE DRAWINGS

These and other features, aspects and advantages of the present invention will become better understood with regard to the following description, appended claims and accompanying drawings where:

DETAILED DESCRIPTION OF THE PREFERRED EMBODIMENTS

Figure 1:
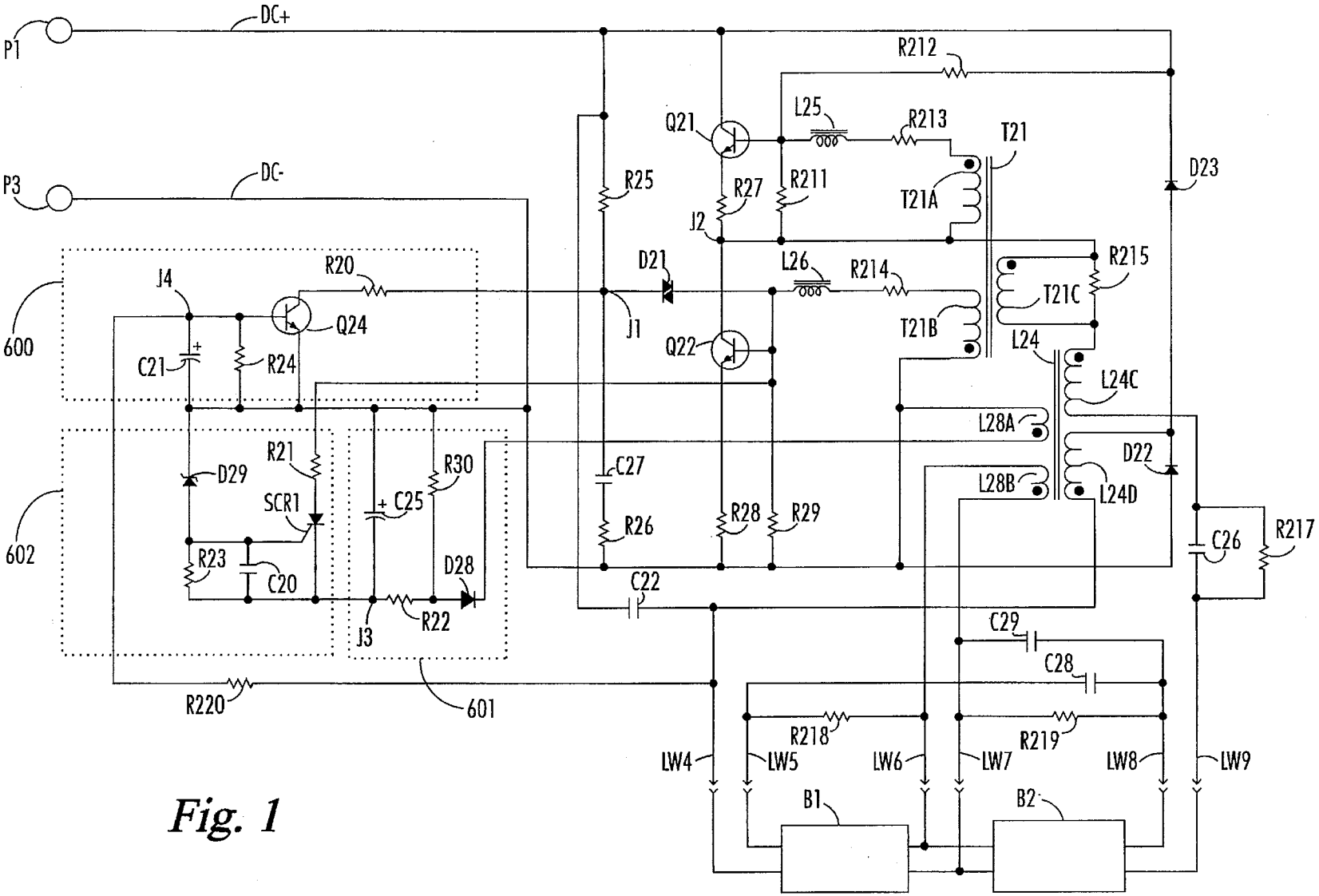
FIG. 1 is a schematic diagram of the preferred embodiment of a lamp protection circuit.

FIG. 1 shows a schematic diagram of the inverter and lamp protection or shutdown circuit for an electronic ballast. A source of DC power (not shown) is connected to terminals P1 and P3. Terminal P1 is connected to a positive bus, DC+, and terminal P3 is connected to a negative bus, DC–. The DC power source is typically a boost power factor correction circuit that produces a DC bus voltage of approximately 380 volts during a preheat interval before boosting occurs, and 550 volts during normal operation. A pair of clamping diodes D22 and D23 are series connected between DC+ and DC–.

The ballast operates a pair of fluorescent lamps, B1 and B2, with high-frequency AC power produced by a series-resonant half-bridge inverter. Other resonant inverter topologies that use at least one switching transistor could also be utilized. Two transistors, Q21 and Q22, are connected in a half bridge configuration between DC+ and DC–. Transistors Q21, and Q22 are shown as bipolar transistors, but the circuit could be adapted to utilize other types of transistors that have a common terminal corresponding to the emitter of a bipolar transistor, a control terminal corresponding to the base, and a switched terminal corresponding to the collector.

The collector of transistor Q21 is connected to DC+. The base of transistor Q21 is connected to DC+ through a starting-aid resistor R212. A damping resistor R211 is connected between the base of transistor Q21 and a junction J2. The emitter of transistor Q21 is connected through a stabilizing resistor R27 to junction J2, which is also connected to the collector of transistor Q22. The emitter of transistor Q22 is connected through a stabilizing resistor R28 to DC–. A damping resistor R29 is connected between the base of transistor Q22 and DC–.

A diac starting circuit provide starting pulses for the inverter. A resistor R25 is connected between DC+ and a junction J1, and provides a current to charge a timing capacitor C27. Capacitor C27 and a current-limiting resistor R26 are connected in series between junction J1 and DC–. A diac D21 is connected between junction J1 and the base of transistor Q22.

A clamping diode is conventionally connected between junctions J1 and J2 to prevent diac D21 from firing after the inverter starts oscillating, so as to prevent simultaneous conduction of transistors Q21 and Q22. It has been found, however, that the clamping diode can be removed so long as the value of resistor R26 is sufficiently large that magnitude of the cross-conduction current is small enough as to be non-destructive to Q22. The average power dissipated due to cross conduction is quite small since the cross-conduction occurs during only a small fraction of the inverter switching cycles.

A toroidal transformer T21 having windings T21A, T21B and T21C is used to supply base drive to transistors Q21 and Q22. Winding T21A is connected to the base of transistor Q21 through a resistor R213 and an inductor L25. Winding T21B is connected to the base of transistor Q22 through a resistor R214 and an inductor L26. Inductors L25 and L26 aid in reducing the fall time of transistors Q21 and Q22. A damping resistor R215 is connected across winding T21C.

A resonant inductor L24 has windings L24A, L24B, L24C and L24D. Winding L24C has one end connected to toroid winding T21C, and the other end coupled to output terminal LW9 through a resonant capacitor C26. Winding L24B supplies filament heating voltage, and is connected to output terminals LW6 and LW7. Winding L24D has one end connected to the junction of clamping diodes D22 and D23, and the other end coupled to DC+ by capacitor C22. Winding L24D limits the inverter output voltage before the lamps strike. During the preheat interval, the output voltage is held to a level that produces minimal glow current in the lamps. When the boost circuit is activated, the output voltage rises in proportion to the increase in the DC bus voltage to a level sufficient to strike lamps B1 and B2. A starting aid capacitor C29 is connected between output terminals LW7 and LW8.

A resonant capacitor C28 is connected between output terminals LW8 and LW9. Capacitor C28 supplies filament heat during the preheat interval. If either lamp is disconnected then the inverter will not start because resonant capacitor C28 is effectively removed from the circuit. Inverter starting will also be inhibited if a filament connected to capacitor C28 is broken. A resonant capacitor C22 is connected between output terminal LW4 and DC+. Resonant capacitors C26 and C22 limit the available fault current at the power-line frequency in case one of the output terminals is accidentally grounded.

A voltage sensing circuit 601 produces a DC sense voltage that is directly related to the magnitude of the inverter output voltage. The DC sense voltage is produced between a voltage-sensor output terminal J3 and DC–. Winding L24A supplies an AC voltage that is rectified by a current-limited rectifier consisting of a diode D8, and resistors R30 and R22. The polarity of the rectified voltage is negative with respect to DC–. The output of the current-limited rectifier is connected to terminal J3. A delay capacitor C25 is connected between DC– and J3 to delay the response of the DC sense voltage to changes in the inverter output voltage.

A trigger circuit 602 provides a negative pulse to shut off the inverter by triggering an SCR, SCR1, when the voltage between DC– and J3 exceeds 9.6 volts. The anode of SCR1 is coupled to the base of transistor Q22 through a current-limiting resistor R21. A sense resistor R23 and a noise suppression capacitor C20 are connected in parallel between the gate and cathode of SCR1. A 9.1 volt zener diode D29 has an anode connected to the gate of SCR1 and a cathode connected to DC–.

An inhibit circuit 600 diverts the charging current supplied by resistor R25 away from the starting circuit when an inhibit signal is present at an inhibit control terminal J4. A transistor Q24 has a collector connected through resistor R20 to junction J1, an emitter connected to DC–, and a base connected to junction J4. A resistor R24 and a delay capacitor C21 are connected in parallel between the base and emitter of Q24.

A continuity sensing circuit provides the inhibit signal to inhibit control terminal J4. A DC voltage is present at terminal J2 as long as power is supplied to the ballast, whether or not the inverter is operating. Windings T21C and L24C provide a DC path between junction J2 and capacitor C26. Resistors R217, R218, R219, and R220 provide links in an inhibit signal current path from the junction of capacitor C26 and winding L24C to terminal J4 that includes one filament from each of lamps B1 and B2. The inhibit signal will be interrupted if either lamp is removed or if either filament in the current path becomes broken.

The lamp protection function of the electronic ballast works as follows. Since a ballast circuits are designed to produce a current output, the inverter output voltage is primarily determined by the lamp characteristics. Abnormal lamp operation results in an increased arc voltage, with the worst case being a deactivated lamp with unbroken filaments that does not strike. Rectifying lamps may produce only a modest increase in the arc voltage, so that condition is more difficult to sense. The DC sense voltage between DC– and J3 is directly related to the magnitude of the inverter output voltage, but it is not proportional. A voltage is developed across sense resistor R23 when the DC sense voltage is greater than the breakdown voltage of zener diode D29. When the voltage across the sense resistor is about 0.6 volts, SCRI fires, and the inverter is turned off. Capacitor C20 is intended to prevent transient noise from triggering SCR1, and may not always be necessary.

Assuming that the input power to the ballast is maintained, inhibit circuit 600 prevents diac D21 from restarting the inverter until a lamp is removed. Removing a lamp prevents the continuity signal from reaching terminal J4. After a short delay, C21 discharges enough to allow Q24 to turn off, which allows D21 to start firing. The inverter will not start, however, until the lamp is replaced, thereby reconnecting capacitor C28, which is part of a series-resonant tank circuit D21. Thus, normal operation will resume without the ballast input power having to be toggled from on to off and back on again.

The duration of the delays in the protection circuits must be appropriate to ensure proper operation. Delay capacitor C25 must prevent triggering during lamp starting. If a power line disturbance causes a momentary interruption of the ballast input power, capacitor C25 must be sufficiently discharged through resistors R22 and R30 so that false triggering will not occur when the lamps are being restarted. When the input power is quickly cycled, delay capacitor C21 must discharge fast enough to allow transistor Q24 to momentarily turn off if the power interruption is long enough to allow the inverter oscillations to die out. Because transistor Q24 may be off for only a short interval, resistor R20 sets the voltage across capacitor C27 to be only a few volts below the diac turn-on threshold so that the diac can quickly fire.

Component values for experimental ballasts built to demonstrate the lamp protection circuits of FIGS. 1–4 are shown in Table 1:

TABLE 1

| Component values | | | |
|---|---|---|---|
| Component | Value or Part # | Component | Value or Part # |
| Q21, Q22 | MJE18004D2 | R15 | 100kΩ |
| Q24 | 2N3904 | R18 | 9.1kΩ |
| SCR1 | 2N5061 | R19 | 62kΩ |
| Q26 | 2N3906 | R20 | 100kΩ |
| | | R21 | 10Ω |
| C15 | .1 uF | R22 | 2kΩ |
| C19 | 47 nF | R23 | 3kΩ |
| C21 | 47 uF | R24 | 4.7kΩ |
| C22 | 47 nF | R25 | 2MΩ |
| C25 | 100 uF | R26 | 82Ω |
| C26 | 15 nF | R27 | 1Ω |
| C27 | .1 uF | R28 | 1Ω |
| C28 | 6.2 nF | R29 | 27.4Ω |
| C20 | 47 nF | R30 | 13kΩ |
| C29 | 470 pF | R31 | 2kΩ |
| C35 | 220 uF | R32 | 15kΩ |
| C36 | .1 uF | R211 | 27.4Ω |
| D21 | SGS DB3M | R212 | 2MΩ |
| D22,D23 | UF4007 | R213 | 6.2Ω |
| D27,D28 | 1N4148 | R214 | 6.2Ω |
| D29 | 9.1v zener | R215 | 62Ω |
| L25,L26 | 10 uH | R217 | 360kΩ |
| D15 | 1N4148 | R218 | 510kΩ |
| | | R219 | 510kΩ |
| | | R220 | 360kΩ |

Figure 2:
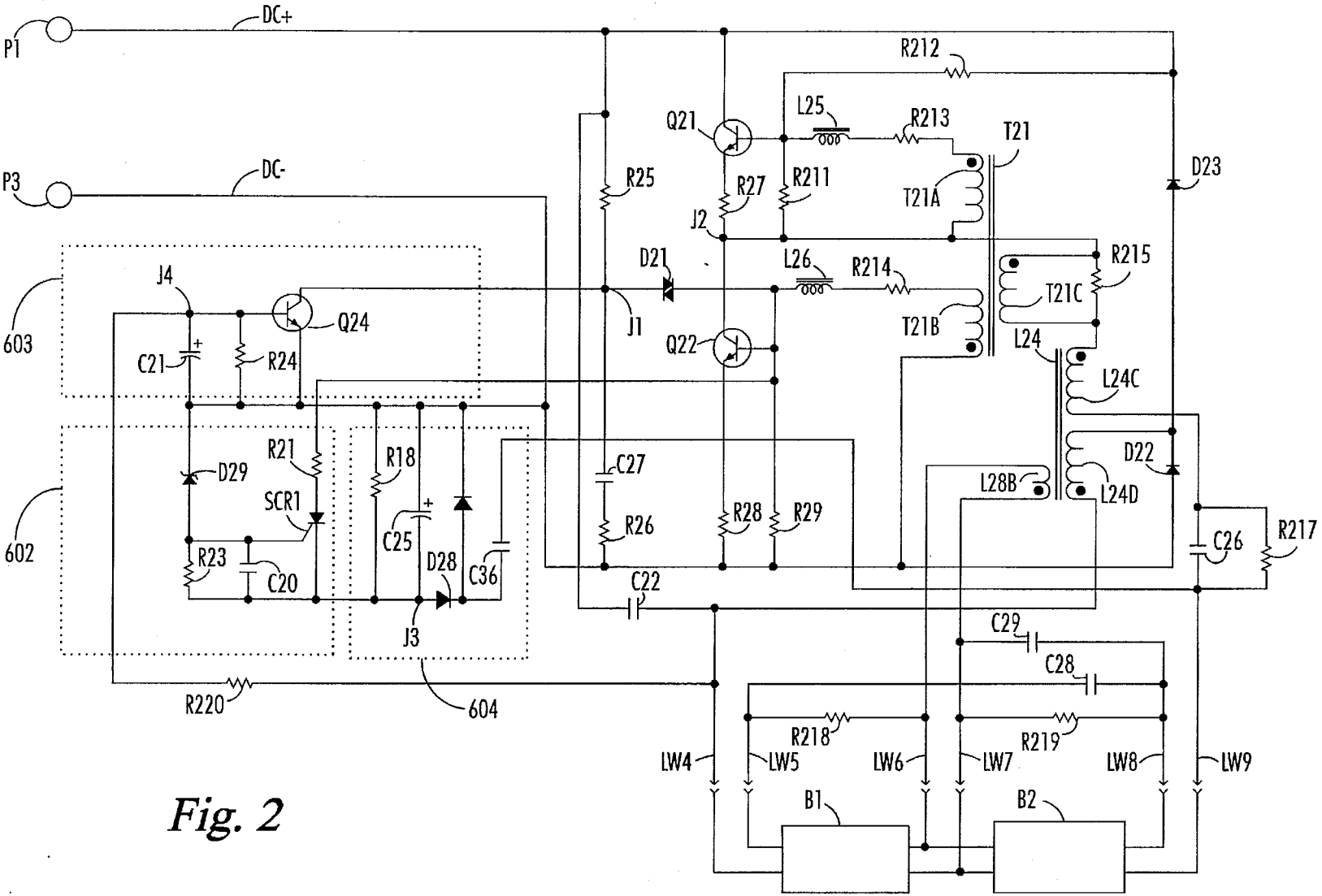
FIG. 2 is a schematic diagram of an alternative embodiment of a lamp protection circuit which utilizes a charge pump in the voltage sensing circuit.

The circuit of FIG. 1 may not have sufficient overvoltage sensing sensitivity for all lamp types. FIG. 2 shows an alternative embodiment of a lamp protection circuit which incorporates a charge pump to achieve greater sensitivity. The AC voltage between output terminal LW9 and DC– is more sensitive to arc voltage variation than the voltage across winding L24A in FIG. 1. The version of L24 shown in FIG. 2 eliminates winding L24A since it is not used. In FIG. 2, voltage sensing circuit 601 is replaced with a voltage sensing circuit 604. A charge-pump capacitor C36 is connected between terminal LW9 and the junction of charge-pump diodes D27 and D28. A negative charge-pump current is produced at the anode of D28. The value of this current is set by choosing the value of capacitor C36. C36 should have much less capacitance than delay capacitor C25, which filters the charge-pump current to produce a DC sense voltage between terminal J3 and DC–. A resistor R18 provides a discharge path for C25, and can be used to set the level of the DC sense voltage.

It was found that resistor R20 was unnecessary for the circuit of FIG. 2. The rest of the circuit functions the same as the previously described version in FIG. 1.

Figure 3:
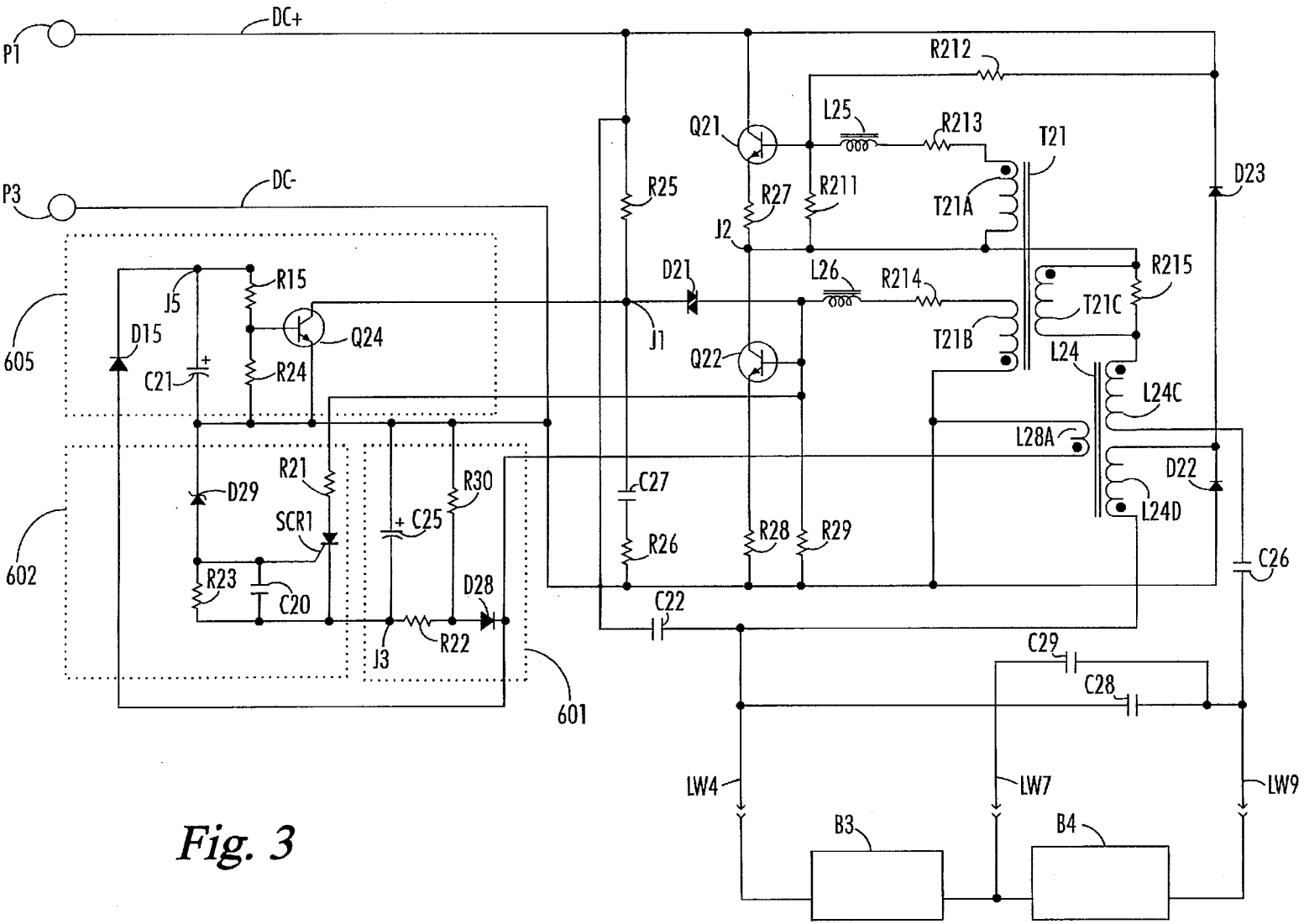
FIG. 3 is a schematic diagram of an alternative embodiment of a lamp protection circuit which periodically attempts to restart the lamp.

FIG. 3 shows another embodiment of a lamp protection circuit that cycles off and on when a defective lamp is present. This circuit is primarily designed to work with instant start lamps, such as B3 and B4, that have only one pin on each lamp end. These lamps do not allow access to the filaments for preheating, or for sensing the presence of the lamps with a continuity sensing circuit.

Several changes from the circuit of FIG. 1 were made in FIG. 3. Inhibit circuit 600 was replaced with inhibit circuit 605, which has a control terminal J5. A diode D15 is connected between one end of winding L24A and terminal J5 to charge delay capacitor C21 whenever the inverter is operating. A resistor R15 is connected between terminal J5 and the base of transistor Q24. Resistor R20 was eliminated. Continuity sensing resistors R217, R218, R219, and R220 were eliminated. Winding L24B was eliminated since there is no filament heating. Inverter output terminals LW5, LW6, and LW8 were eliminated.

The inhibit circuit 605 functions differently from circuit 600 in FIG. 1. Instead of having the inverter staying off after it is shut down until a lamp is replaced, the inverter comes back on after C21 has discharged. This cycle will repeat resulting in a lamp that flashes or blinks. Since the lamp is off more than it is on in this condition, the circuit will protect the lamp from overheating. When a new lamp is inserted, normal operation will resume.

Figure 4:
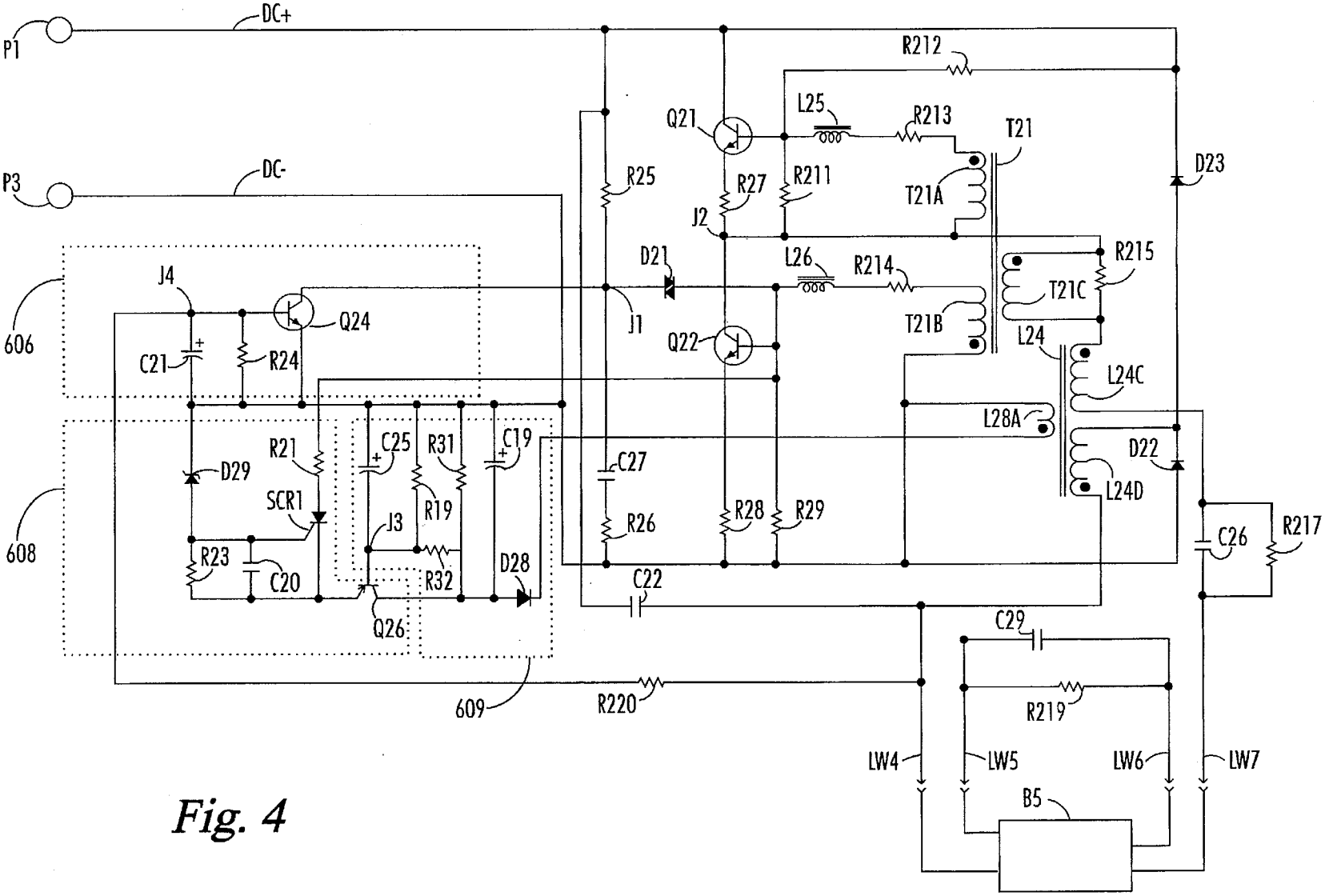
FIG. 4 is a schematic diagram of an alternative embodiment of a sensitive lamp protection circuit that is particularly useful for one-lamp ballasts.

FIG. 4 shows an alternative embodiment of a lamp protection circuit which is particularly suited for one-lamp ballasts. One lamp ballasts generally have a greater ratio between the lamp starting and operating voltages than do ballasts having two series-connected lamps. If voltage sensing circuit 601 in FIG. 1 were used with a one lamp ballast, delay capacitor C25 would have to be much larger to prevent the circuit from shutting down during lamp starting. Additionally, one lamp ballasts may produce smaller changes in the voltage across winding L24A o for a given percentage change in the arc voltage than two-lamp ballasts, so it may be necessary to set the trigger threshold close to the normal operating level of the DC sense voltage. These problems are addressed in FIG. 4 with replacing voltage sensing circuit 601 with a voltage sensing circuit 609 and replacing trigger circuit 602 with a trigger circuit 608.

Voltage sensing circuit 609 is designed to charge delay capacitor 25 slowly, but to discharge it quickly. A resistor R31 and a capacitor C19, along with diode D28, form a peak following circuit. A charging resistor R32 is connected between the anode of D28 and terminal J3. A trimming resistor R19 is connected in parallel with capacitor C25. A PNP transistor Q26 has functions in circuits 608 and 609. The base of transistor Q26 is connected to terminal J3, and the collector is connected to the anode of D28. If power is removed from the ballast, the collector-base junction of transistor Q26 will become forward biased, quickly discharging capacitor C25 through resistor R31. This allows the normal value of the DC sense voltage to be set close to the threshold voltage without having the risk of false triggering during momentary power outages.

In trigger circuit 608, transistor Q26 functions as a voltage follower to reduce loading on voltage sensor output terminal J3. This allows R22 to be increased to obtain longer delays without increasing the value of capacitor C25. The emitter of transistor Q26 is connected to the cathode of SCR1.

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. An electronic ballast for powering at least one gas discharge lamp comprising:

an inverter having a resonant inductor, a switching transistor, a plurality of output terminals, and an output voltage, the switching transistor having a common terminal and a control terminal, the common terminal coupled to a negative DC supply terminal;

voltage sensing means for providing at a voltage-sensor output terminal a DC sense voltage having a magnitude that is directly related to the magnitude of the inverter output voltage, and negative in polarity with respect to the negative DC supply terminal, the voltage sensing means including a delay capacitor connected between the negative DC supply terminal and the voltage-sensor output terminal for delaying the response of the DC sense voltage to changes in the inverter output voltage; and trigger means for providing a negative pulse to shut off the inverter by discharging the delay capacitor into the control terminal of the switching transistor when the magnitude of the DC sense voltage exceeds a threshold level, thereby preventing the ballast from providing sustained output power when the magnitude of the inverter output voltage indicates abnormal lamp operation.

2. The electronic ballast according to claim 1, wherein the trigger means comprises:

a zener diode having an anode and a cathode, the anode coupled to the voltage-sensor output terminal through a sense resistor, and the cathode connected to the negative DC supply terminal;

a silicon controlled rectifier having an anode, a cathode, and a gate, the anode coupled to the control terminal of the switching transistor through a discharge resistor, the cathode connected to the voltage-sensor output terminal, and the gate connected to the anode of the zener diode.

3. The electronic ballast according to claim 1, wherein the voltage sensing means further comprises: a sense winding magnetically coupled to the resonant inductor, and current-limited rectifier means connected between an end of the sense winding and the voltage-sensor output terminal.

4. The electronic ballast according to claim 1, wherein the voltage sensing means further comprises: a charge pump circuit having an AC input terminal and a DC output terminal, the AC input terminal coupled to an inverter output terminal, and the DC output terminal connected to the voltage-sensor output terminal.

5. The electronic ballast according to claim 1, wherein the voltage sensing means further comprises:

a sense winding magnetically coupled to the resonant inductor, and a charge pump circuit having an AC input terminal and a DC output terminal, the AC input terminal coupled to an end of the sense winding, and the DC output terminal connected to the voltage-sensor output terminal.

6. The electronic ballast according to claim 1, wherein the voltage sensing means further comprises:

a sense winding magnetically coupled to the resonant inductor;

a rectifier diode having an anode and a cathode, the cathode connected to an end of the sense winding, and the anode coupled to the voltage-sensor output terminal through a charging resistor;

a second capacitor having a capacitance less than the capacitance of the delay capacitor, the second capacitor connected between the anode of the rectifier diode and the negative DC supply terminal; and a discharge resistor connected in parallel with the second capacitor, the discharge resistor having a resistance less than the resistance of the charging resistor.

7. The electronic ballast according to claim 6, wherein the trigger means comprises:

a PNP transistor having a base, an emitter, and a collector, the collector connected to the anode of the rectifier diode, and the base connected to the voltage-sensor output terminal;

a zener diode having an anode and a cathode, the anode coupled to the emitter of the PNP transistor through a sense resistor, and the cathode connected to the negative DC supply terminal; and a silicon controlled rectifier having an anode, a cathode, and a gate, the anode coupled to the control terminal of the switching transistor through a discharge resistor, the cathode connected to the emitter of the PNP transistor, and the gate connected to the anode of the zener diode.

8. An electronic ballast for powering at least one gas discharge lamp comprising:

a power supply having a positive DC supply terminal and a negative DC supply terminal;

an inverter having a resonant inductor, a switching transistor, a plurality of output terminals, and an output voltage, the switching transistor having a common terminal and a control terminal, the common terminal coupled to the negative DC supply terminal;

starting means for providing at least one starting pulse to the control terminal of the switching transistor, the starting means receiving a starting current through a starting current source;

inhibit means having an inhibit control terminal and operative to disable the starting means by shunting the starting current away from the starting means after a delay period following receipt of an inhibit signal at the inhibit control terminal;

voltage sensing means for providing at a voltage-sensor output terminal a DC sense voltage having a magnitude that is directly related to the magnitude of inverter output voltage and negative in polarity with respect to the negative DC supply terminal, the voltage sensing means including a delay capacitor connected between the negative DC supply terminal and the voltage-sensor output terminal for delaying the response of the DC sense voltage to changes in the inverter output voltage; and trigger means for providing a negative pulse to shut off the inverter by discharging the delay capacitor into the control terminal of the switching transistor when the magnitude of the DC sense voltage exceeds a threshold level, thereby preventing the ballast from providing sustained output power when the magnitude of the inverter output voltage indicates abnormal lamp operation.

9. The electronic ballast of claim 8, further comprising:

continuity sensing means for providing the inhibit signal to the inhibit control terminal, the continuity sensing means connected to at least two of the inverter output terminals and operable to sense the presence of intact lamp filaments, such that disconnecting one of the lamp(s) from the ballast will interrupt the inhibit signal.

10. The electronic ballast of claim 8, further comprising a resonant capacitor connected to at least two of the inverter output terminals so that a resonant current flowing through the resonant capacitor also flows through at least one filament of said at least one gas discharge lamp, thereby preventing the inverter from starting when lamp removal or filament breakage prevents the resonant current from flowing.

11. The electronic ballast of claim 8, further comprising inverter operation sensing means for providing the inhibit signal to the inhibit control terminal whenever the inverter is operating.

12. The electronic ballast according to claim 8, wherein the trigger means comprises:

a zener diode having an anode and a cathode, the anode coupled to the voltage-sensor output terminal through a sense resistor, and the cathode connected to the negative DC supply terminal; and a silicon controlled rectifier having an anode, a cathode, and a gate, the anode coupled to the control terminal of the switching transistor through a discharge resistor, the cathode connected to the voltage-sensor output terminal, and the gate connected to the anode of the zener diode.

13. The electronic ballast according to claim 8, wherein the voltage sensing means further comprises: a sense winding magnetically coupled to the resonant inductor, and current-limited rectifier means connected between an end of the sense winding and the voltage-sensor output terminal.

14. The electronic ballast according to claim 8, wherein the voltage sensing means further comprises: a charge pump circuit having an AC input terminal and a DC output terminal, the AC input terminal coupled to one of the inverter output terminals, and the DC output terminal connected to the voltage-sensor output terminal.

15. The electronic ballast according to claim 8 wherein the voltage sensing means further comprises:

a sense winding magnetically coupled to the resonant inductor; and a charge pump circuit having an AC input terminal and a DC output terminal, the AC input terminal coupled to an end of the sense winding, and the DC output terminal connected to the voltage-sensor output terminal.

16. The electronic ballast according to claim 8, wherein the voltage sensing means further comprises:

a sense winding magnetically coupled to the resonant inductor;

a rectifier diode having an anode and a cathode, the cathode connected to an end of the sense winding, and the anode coupled to the voltage-sensor output terminal through a charging resistor;

a second capacitor having a capacitance less than the capacitance of the delay capacitor, the second capacitor connected between the anode of the rectifier diode and the negative DC supply terminal; and a discharge resistor connected in parallel with the second capacitor, the discharge resistor having a resistance less than the resistance of the charging resistor.

17. The electronic ballast according to claim 16, wherein the trigger means comprises:

a PNP transistor having a base, an emitter, and a collector, the collector connected to the anode of the rectifier diode, and the base connected to the voltage-sensor output terminal;

a zener diode having an anode and a cathode, the anode coupled to the emitter of the PNP transistor through a sense resistor, and the cathode connected to the negative DC supply terminal; and a silicon controlled rectifier having an anode, a cathode, and a gate, the anode coupled to the control terminal of the switching transistor through a discharge resistor, the cathode connected to the emitter of the PNP transistor, and the gate connected to the anode of the zener diode.

18. A method of operating at least one gas-discharge lamp connected to an electronic ballast, comprising the steps of:

(a) starting an inverter with a starting means;

(b) providing from the inverter a current-limited output voltage for operating at least one gas-discharge lamp from a plurality of output terminals, the inverter having a switching transistor, the switching transistor having a common terminal and a control terminal, the common terminal coupled to a negative DC supply terminal;

(c) developing a DC sense voltage across a delay capacitor, the DC sense voltage having a magnitude that, after a time delay, is directly related to the magnitude of the inverter output voltage, and the negative in polarity with respect to the negative DC supply terminal; and (d) shutting off the inverter by discharging the delay capacitor into the control terminal of the switching transistor when the magnitude of the DC sense voltage exceeds a threshold level, thereby preventing the ballast from providing sustained output power when the magnitude of the inverter output voltage indicates abnormal lamp operation.

19. The method of claim 18, further comprising the steps of:

(a) applying an inhibit signal to an inhibit control terminal of an inhibit means through a path that includes at least two output terminals, such that the inhibit signal will be interrupted if one of the lamp(s) is disconnected from the ballast;

(b) disabling the starter means after a first delay following receipt of the inhibit signal at the inhibit means control terminal; and (c) enabling the starter means after a second delay following interruption of the inhibit signal at the inhibit means control terminal.

20. The method of claim 18, further comprising the steps of:

(a) applying an inhibit signal to an inhibit control terminal of an inhibit means whenever the inverter is operating;

(b) disabling the starter means after a first delay following receipt of the inhibit signal at the inhibit means control terminal; and (c) enabling the starter means after a second delay following interruption of the inhibit signal at the inhibit means control terminal.

* * * * *